United States Patent [19]

Axmark et al.

[11] 4,370,557

[45] Jan. 25, 1983

[54] DUAL DETECTOR FLAME SENSOR

[75] Inventors: Roger E. Axmark; Ernest A. Satren, both of Bloomington, Minn.

[73] Assignee: Honeywell Inc., Minneapolis, Minn.

[21] Appl. No.: 181,580

[22] Filed: Aug. 27, 1980

[51] Int. Cl.[3] ..... H05B 33/00

[52] U.S. Cl. ..... 250/554; 431/79; 340/578

[58] Field of Search ..... 431/79; 250/554, 208, 250/209, 214 R; 340/577, 578

[56] References Cited

U.S. PATENT DOCUMENTS

| | | | |
|---|---|---|---|
| 3,689,773 | 9/1972 | Wheeler | 250/554 |
| 3,716,717 | 2/1973 | Scheidweiler | 250/554 |
| 3,967,255 | 6/1976 | Oliver et al. | 250/554 |
| 4,039,844 | 8/1977 | MacDonald | 340/578 |
| 4,206,454 | 6/1980 | Schapira et al. | 250/554 |

*Primary Examiner*—David C. Nelms

*Attorney, Agent, or Firm*—Omund R. Dahle

[57] ABSTRACT

In a multi-burner boiler or industrial furnace installation that uses pulverized coal for fuel and utilizes an oil pilot torch it has been difficult to sense and discriminate satisfactorily between safe and unsafe burner operation in these multi-burner arrangements. By using both a Si detector (visible light responsive) and a lead sulfide detector (infrared responsive) and selectively combining the signals therefrom, the best characteristics of both detectors are utilized to provide satisfactory flame sensing.

12 Claims, 12 Drawing Figures

CURVE
FRONT-FIRED BOILER
F DARK BACKGROUND
G COAL - NORMAL
H COAL - BRIGHT (DAMPER ALMOST CLOSED)
I COAL - DARK (DAMPER FULLY OPEN)
J COAL - DARK
K BACKGROUND FIREBALL
L OIL
AMPLITUDE - ARBITRARY UNITS
RELATIVE PbS (1.1-3μm) RESPONSE FROM 75-400 HZ
700
600
500
400
300
200
100
0
100
200
300
400
FLICKER FREQUENCY - HZ
G
L
H
J
K
I
F

CURVE
FRONT-FIRED BOILER
F DARK BACKGROUND
G COAL-NORMAL
H COAL-BRIGHT (DAMPER ALMOST CLOSED)
I COAL-DARK (DAMPER FULLY OPEN)
J COAL-DARK
K BACKGROUND FIREBALL
L OIL (MULTIPLY AMPLITUDE SCALE BY 2)
AMPLITUDE - ARBITRARY UNITS
RELATIVE Si (0.35-1.13μm) RESPONSE FROM 75-400HZ
700
600
500
400
300
200
100
0
100
200
300
400
FLICKER FREQUENCY - HZ
L
H
G
K
F&I

DUAL DETECTOR FLAME SENSOR

FIELD OF THE INVENTION

The field of the invention is in the use of dual flame sensors in multi-burner boiler and industrial furnace installations.

BACKGROUND AND SUMMARY OF THE INVENTION

Industrial requirements often result in the use of multi-burner boiler and industrial furnace installations that utilize a fossil fuel like pulverized coal for fuel and utilize an oil pilot flame. Neither a lead sulfide nor a silicon detector used separately have been able to sense and discriminate satisfactorily between safe and unsafe burner operation in these multi-burner arrangements. A system utilizing both a lead sulfide (PbS) detector and a silicon (Si) detector is effective to combine the best characteristics of both detectors to provide satisfactory flame sensing. More specifically the coal flame sensor of this invention has shown the capability of providing flame recognition with discrimination between supervised burner, adjacent burners and the background fireball for boilers fueled with pulverized coal at widely varying loads. While specific reference is made in this specification to pulverized coal for fuel and utilizing an oil pilot torch to ignite the coal, it should be noted that in addition to pulverized coal fuel boilers, the present invention is also useful with other fuels such as waste fuel fired boilers, in the pulp and paper industry liquor recovery boilers, and in heavy oil burners as well.

As stated above in order to sense the flame condition more accurately two dissimilar sensors are used, one of which is made of Si and the other is PbS. In a simplified explanation of the operation of the system it may be said that the flames of the multi-burner array all characteristically have both a DC and an AC component in radiation intensity. The AC components of the various flames in the boiler generally cancel out, so that the only significant AC component to be observed comes from the nearest flame, i.e. the one under observation. A problem which when using the PbS sensor only is that the high level DC signal from the background fireball tends to reduce the AC or flicker sensitivity of the PbS sensor. The problem when using a Si sensor only is related to the limited range of wavelength to which it is sensitive. The Si sensor is sensitive primarily in the visible region as opposed to the IR (infrared) region where the PbS sensor operates. Due to combined effects of the masking effect of coal dust on visible light and the lower level of the AC signal in that visible region of the spectrum of the flame the pulverized coal will produce very little flicker signal for detection by the Si sensor. The oil pilot flame, however, produces a strong visible flicker and because of its positioning is subject to very little masking. The AC signals from each of the sensors are summed. The DC signal from the Si sensor is used to control the gain applied to the AC signals. The system is arranged with a signal divider so that this gain varies as an inverse function of the DC signal observed by the Si cell. While specific reference is made in this invention to the infrared sensitive detector PbS, it should be noted that other infrared sensors may be used such as lead selenide or germanium detectors either with or without an appropriate optical bandpass filter.

In these multi-burner array furnaces a number of possible situations may arise. If a number of burners other than the burner being observed are operating, there will be a background fireball but the AC component seen by the dual detector of the burner being observed will be substantially non-existent and the alarm will indicate. When the oil fed pilot touch is inserted into the burner being observed, the oil flame provides a strong AC component signal in the visible range which is seen by the Si sensor, so the indicator shows a safe condition. When pulverized coal is then fed to the burner and the main flame (coal) is ignited and burning, the magnitude signals both DC and AC will decrease in visible range but AC will increase in IR range to show a safe condition.

Prior art such as the patent to Wheeler U.S. Pat. No. 3,689,773 entitled "Flame Monitor System and Method Using Multiple Radiation Sensors" shows the use of two identical radiation sensors to simultaneously sense radiation from two different parts of a flame exhibiting high radiation fluctuations. In the present invention, to discriminate the condition of the flame more accurately, two differing or dissimilar sensors one a PbS (1-3 um) and the other a Silicon (0.35-1.1 um) are used.

DESCRIPTION

Figure 1:
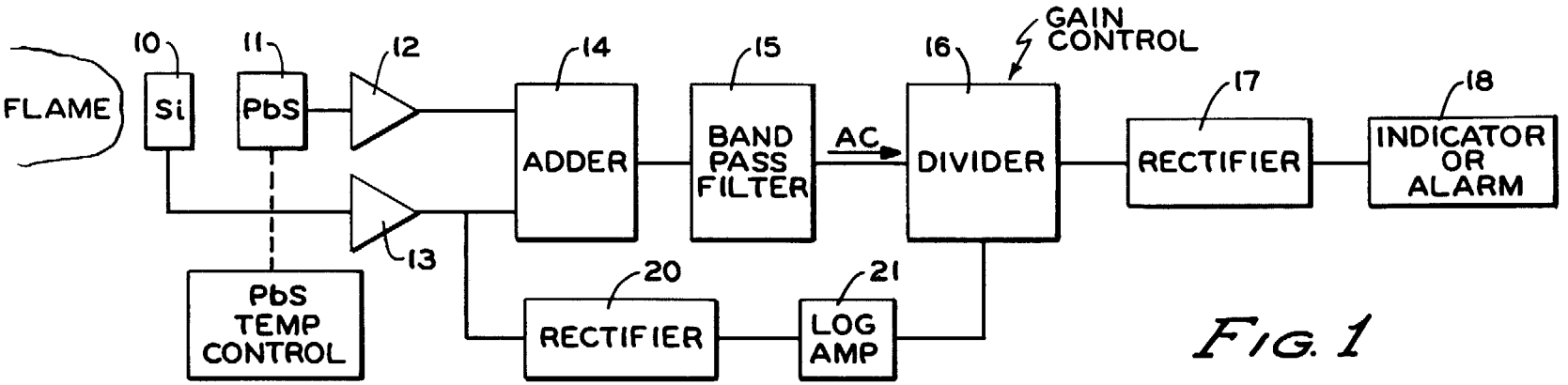
FIG. 1 is a block diagram presentation of the apparatus of the invention.
Figure 2A:
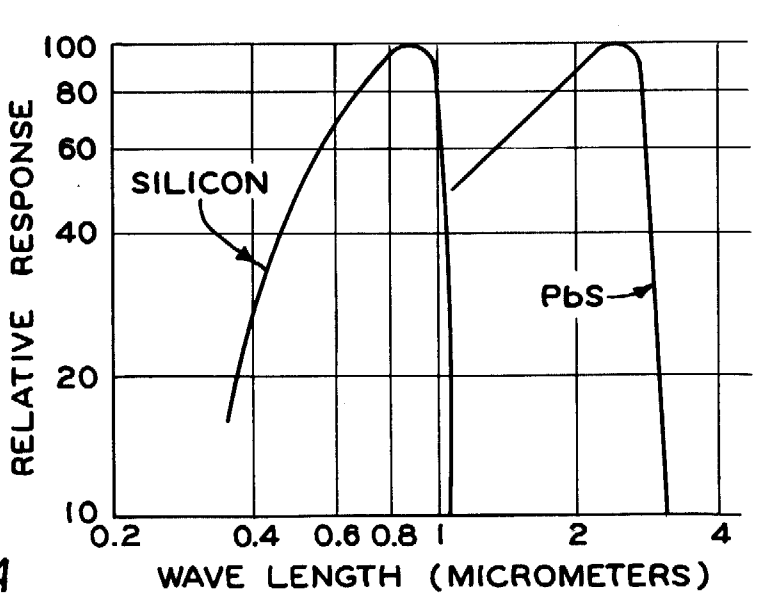
FIG. 2*a* is a graphical presentation of the response curves of the Si and PbS detectors.
Figure 2:
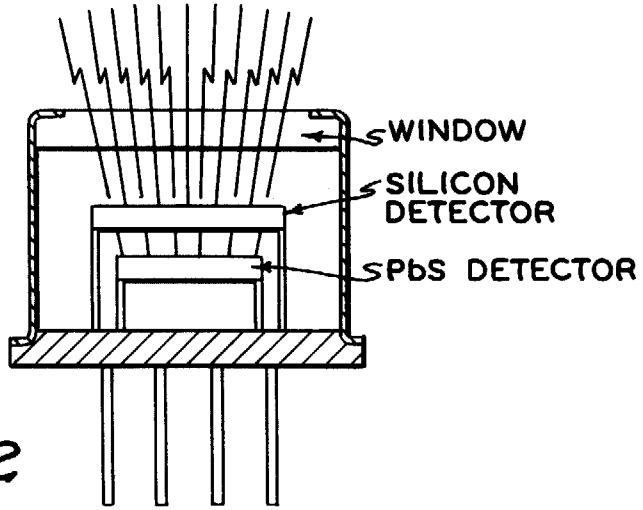
FIG. 2 is a sketch of one embodiment of a Si detector and PbS detector for use in the invention.

Referring now to FIG. 1 there is shown a block diagram of the coal flame sensor apparatus of this invention which uses two dissimilar flame sensors positioned to receive energy, sensor 10 is a silicon (Si) sensor which responds to radiant energy mainly in the visible light wavelength range and sensor 11 is a lead-sulfide (PbS) sensor which responds to radiant energy in the infrared wavelength. Since the Si sensor is a photovoltaic device and the PbS sensor is a photoconductive device it will be understood that a slightly differing circuit will be used to obtain the output signals from the dissimilar sensors. A known characteristic of pulverized coal and oil flames is that they produce a flicker, that is, there is a varying intensity component to the flame which results in an AC component or ripple as well as a DC level in the electrical signal output of the Si and PbS sensors. Suitable signal pre-amplifiers 12 and 13 are connected to the output of sensors 10 and 11, respectively. In one successful embodiment of the invention the flame sensors comprise an Infrared Industries two-color detector, Type 9001, consisting of a lead sulfide cell mounted in-line behind a Si cell and having a composite spectral response of 0.35 to 3 um, the Si cell having a spectral response band of 0.35–1.1 and the PbS cell having a response band of 1.1 to 3 um. FIG. 2 shows the general layout of the two-color detector.

The electrical output signals of the two preamps 12 and 13 are summed in an adder 14 and since it is the AC component which is desired, the output therefrom is connected through a band-pass filter 15 and the AC output is connected to a gain control circuit 16, (i.e. a divider) and then through a rectifier 17 to an indicator 18. In one preferred embodiment the flame flicker band-pass was 75 to 400 Hz. The signal output of preamp 13 of FIG. 1 is also connected to a rectifier 20, the rectified output signal then being fed through a non-linear amplifying means such as a logarithmic amplifier 21. The non-linear amplifying means is for compressing the dynamic range of the signal from Si detector 10 which signal may vary in intensity by orders of magnitude, to provide an output signal which is a function of the input but compressed in dynamic range. The output of logarithmic amplifier 21 is applied as a control signal to the gain control circuit 16.

The flicker characteristics of the flame, both in the visible spectrum and in the IR spectrum is significant in this invention. The visible spectrum and near IR characteristics are presented by the output signal of the Si sensor and the IR spectrum characteristics by the output signal of the PbS sensor.

Figure 3:
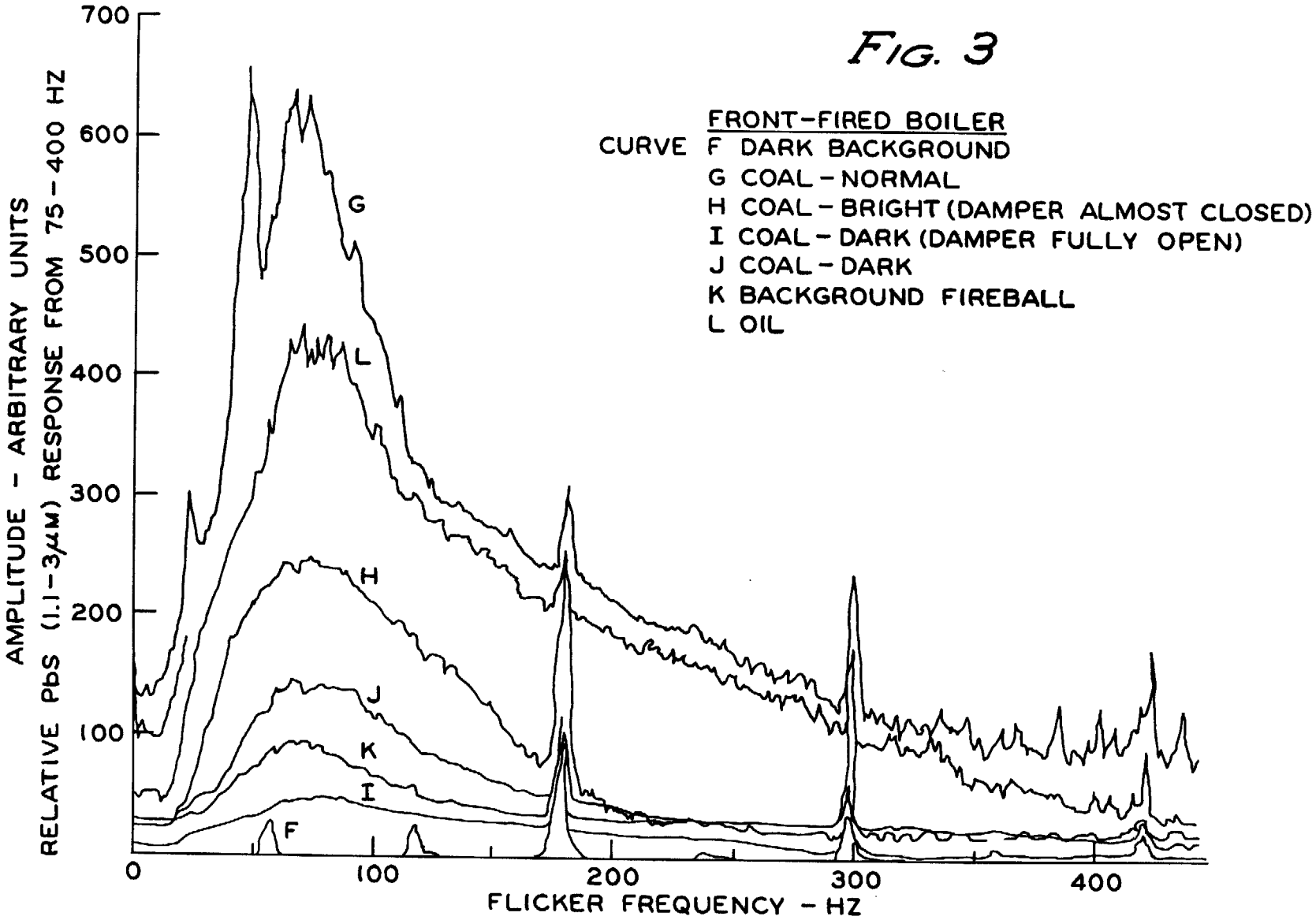
FIG. 3 is a graph showing response curves of detector output vs. flicker frequency for the PbS (1.1-3 um) detector.
Figure 4:
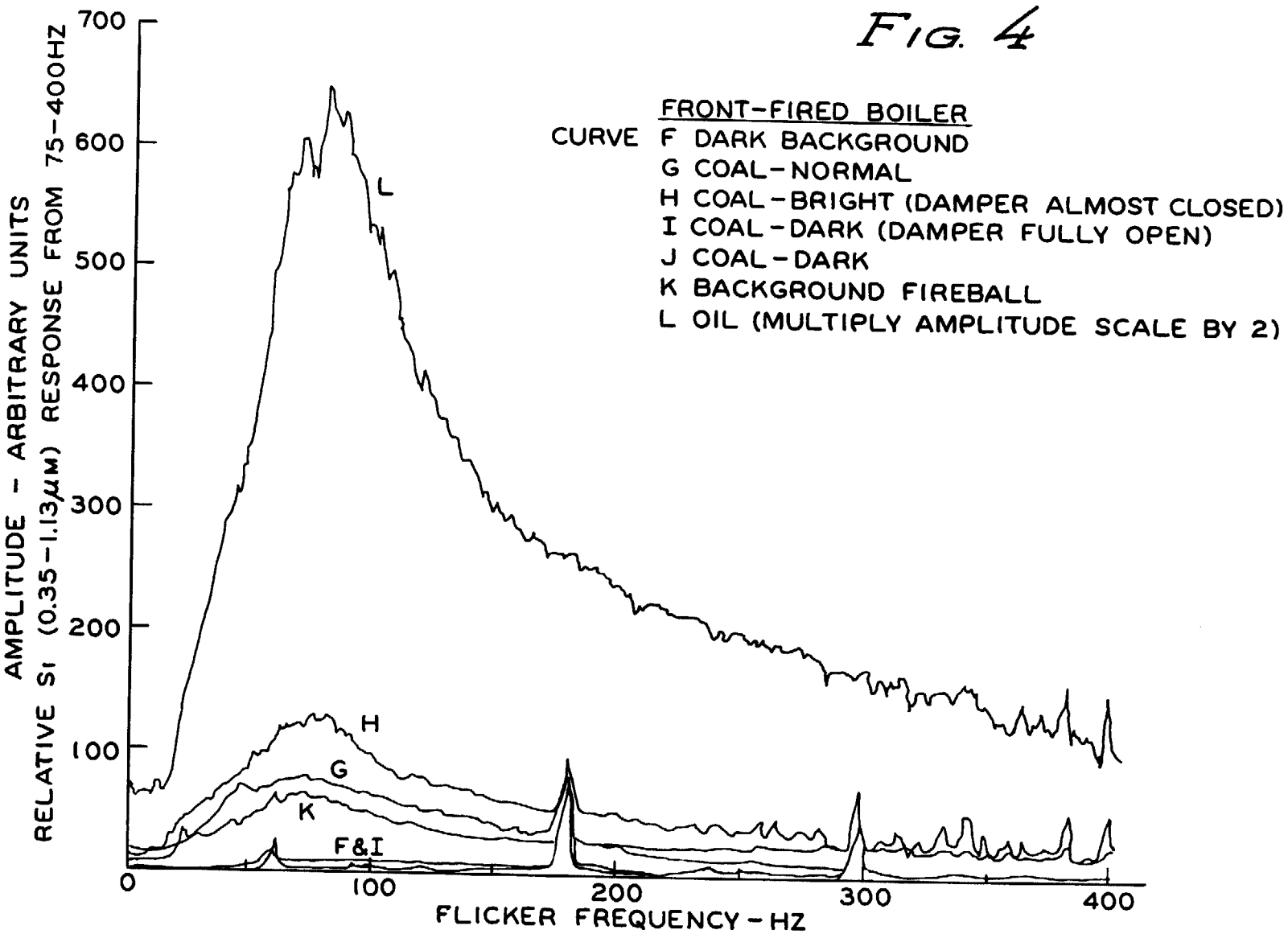
FIG. 4 is a graph showing response curves of detector output vs. flicker frequency for the Si (0.35-1.1 um) detector.

In the use of pulverized coal for fuel in multi-burner boilers the character of the flame produced varies widely with changes in load, fuel and firing conditions depending on the fuel conditions such as wetness of the coal, obscuration of flames by unburned fuel, boiler load variations from 50 to 100% and there must also be discrimination between dark coal flames and the background fireball. FIG. 3 is a graphical presentation of the flicker frequency (75–400 Hz) response in the infrared spectrum (1.1–3 um) for one multi-burner boiler installation. The curves F-L show the AC component of radiation for varying flame conditions including normal coal flame, bright coal flame, dark coal flame, background fireball, and from the oil pilot torch. FIG. 4 is similar to FIG. 3 and is a graphical presentation of the flicker frequency (75–400 Hz) response generally in the visible spectrum (0.35–1.1 um) in the same boiler installation. The curves F-L are for the same flame conditions as discussed above. It will be noted there is a large AC component (curve L) in the oil flame at visible (Si sensor) frequencies (FIG. 4) as compared to the same curve at IR frequencies (FIG. 3). It may be noted that the IR responsive graph (FIG. 3) indicates that the PbS cell does generally better at recognizing coal flames than does the Si sensor. Thus the curves G (coal, normal), H (coal, bright, damper almost closed) and curve J (coal, dark flame) show relatively good flicker signals.

Figure 5:
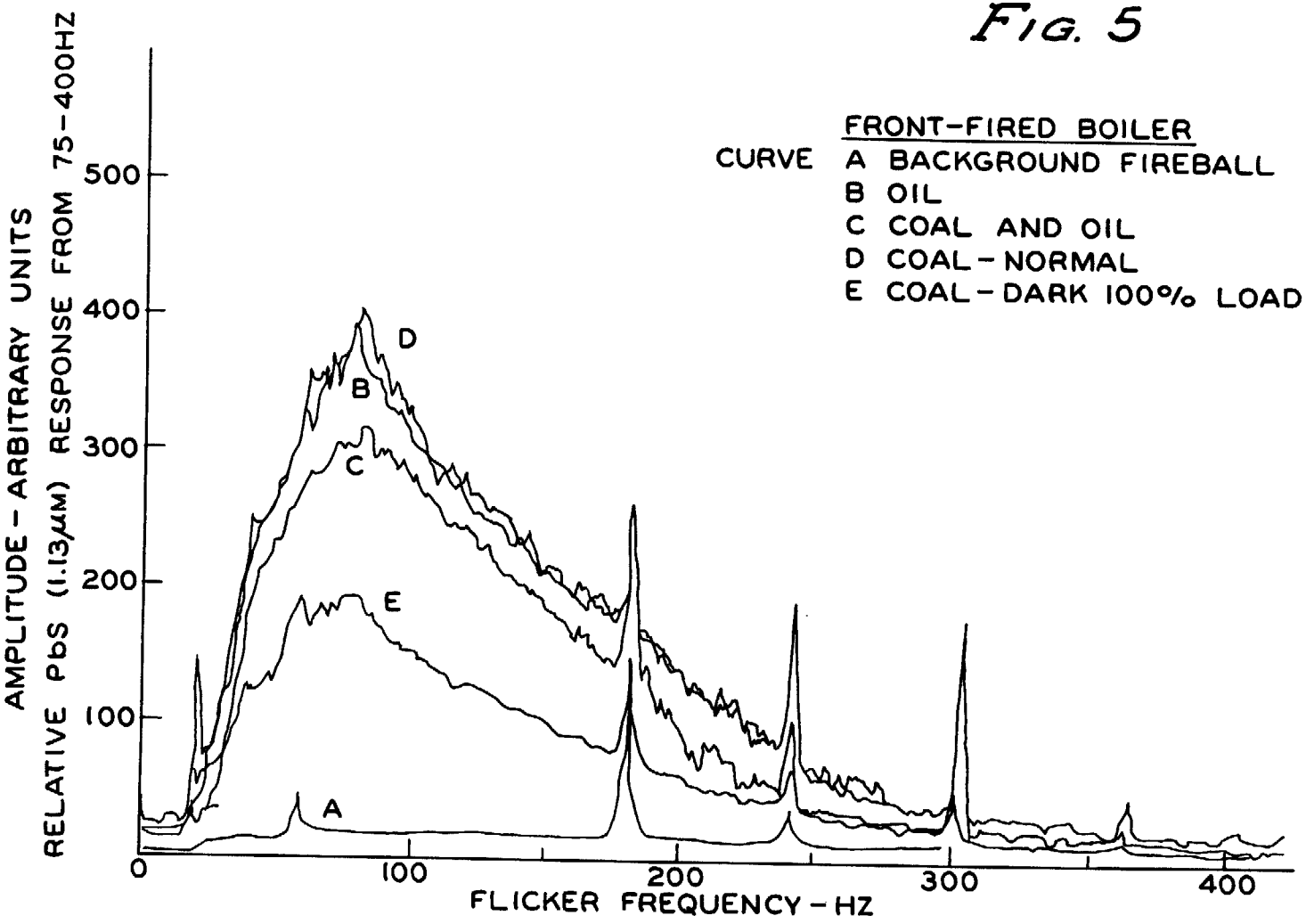
FIGS. 5 and 6 are similar to FIGS. 3 and 4 taken in another installation.

FIG. 5 is a graphical presentation of the detector signal amplitude (PbS) vs. flame flicker frequency in another multi-burner boiler installation with curves for several flame conditions including normal coal flame (curve D); coal dark, 100% load (curve E); coal and oil (curve C); oil flame (curve B); and background fireball (curve A). Again it can be seen that the flicker radiation picked up by the infrared responsive sensor (PbS) provides good signals for the various coal flames.

Figure 6:
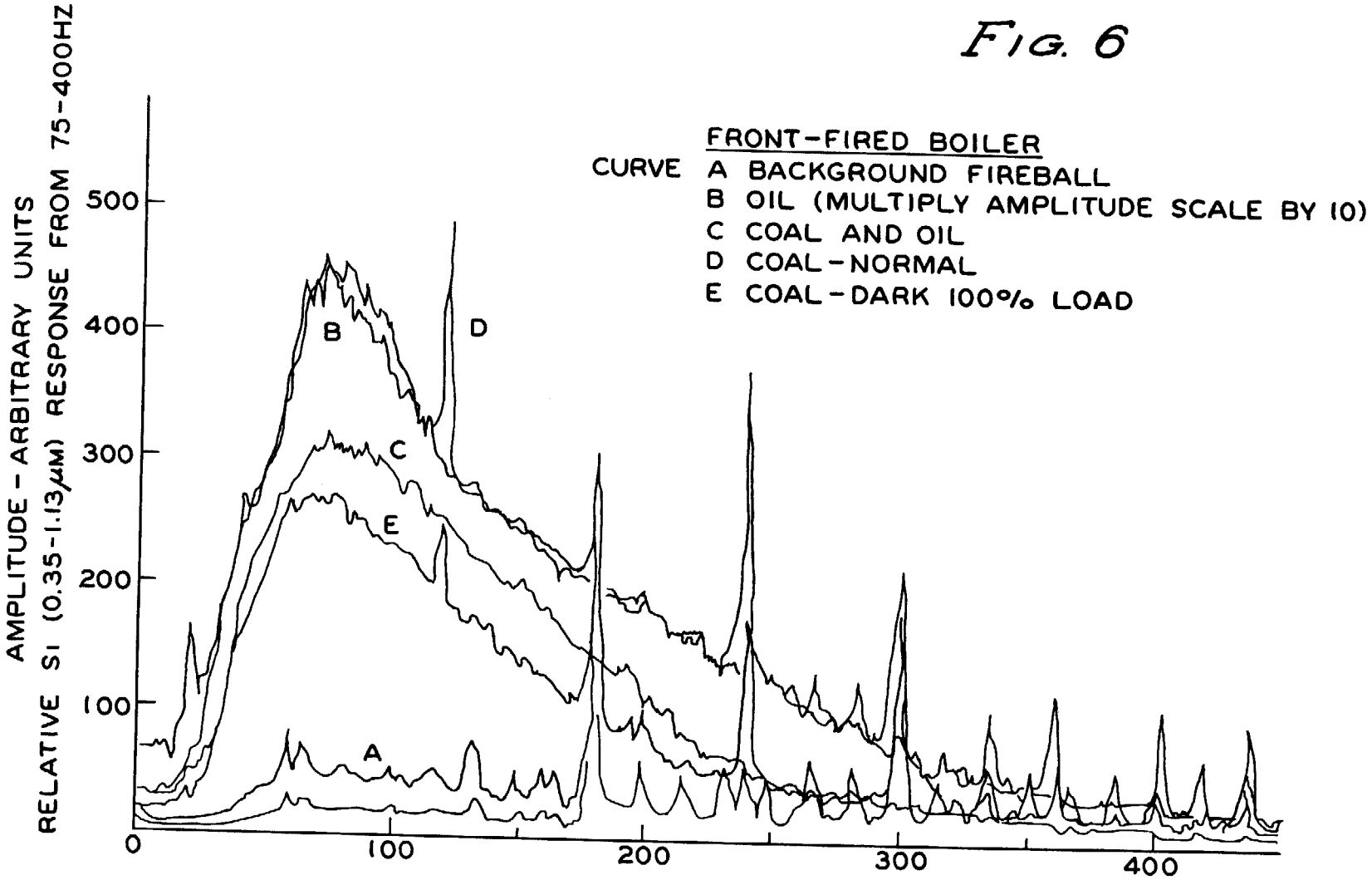

FIG. 6 is similar to FIG. 5 but is a graph of the Si detector signal amplitude vs. flame flicker frequency. The Si sensor response is basically in the visible spectrum (0.35–1.1) and it can be seen from curve B (multiply amplitude scale by 10) that the oil flame has a large flicker frequency component in the visible spectrum.

Figure 7:
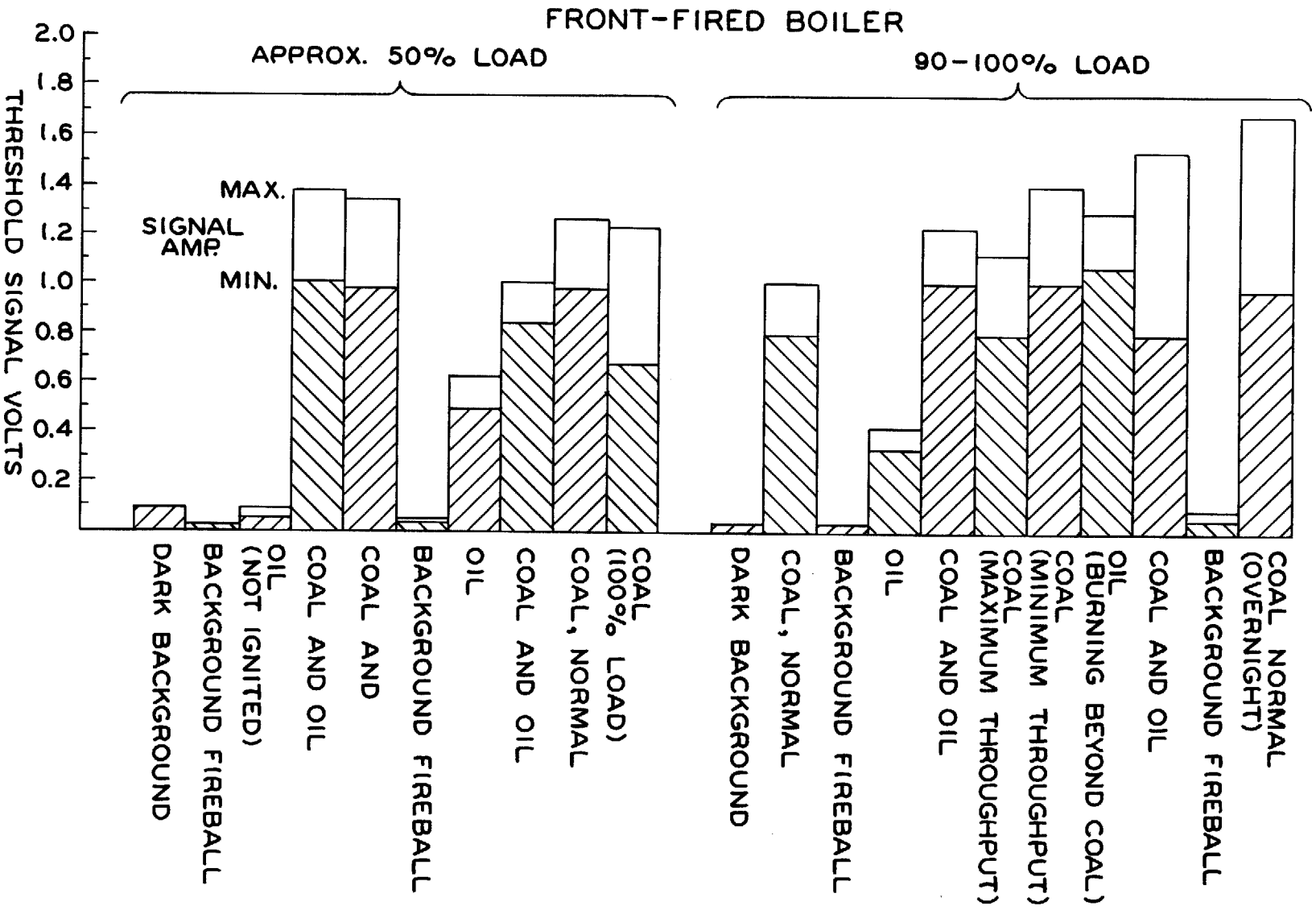
FIG. 7 is a bar graph of signal input to the alarm circuit based on the same installation as in FIGS. 5 and 6.

FIGS. 3, 4, 5 and 6 all represent signals from the sensors 10 and 11. FIG. 7, which relates to the same installation as in FIGS. 5 and 6, is a bar graph of signal levels as processed by the apparatus of the invention and as measured at the input to the indicator or alarm 18. The height of the bar represents the amplitude of the signal to the alarm circuit. Maximum and minimum excursions of the signal during a test run are represented by the white portion of the bars. The bar graph shows it is possible to set an alarm level that allows discrimination between burner-lit and burner-out conditions.

Figure 8:
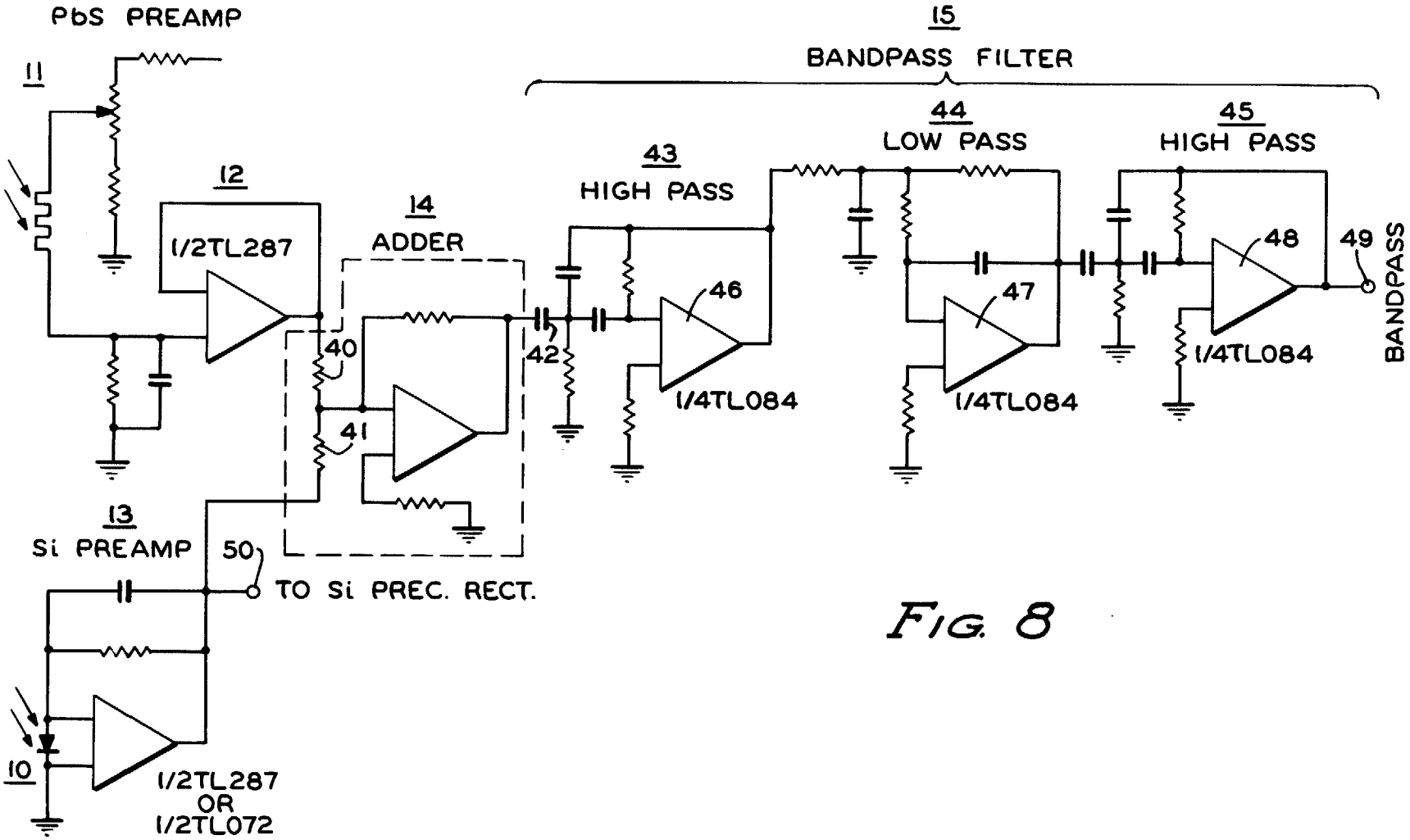
FIGS. 8, 9 and 10 are schematic diagrams of the apparatus shown in FIG. 1.
Figure 9:
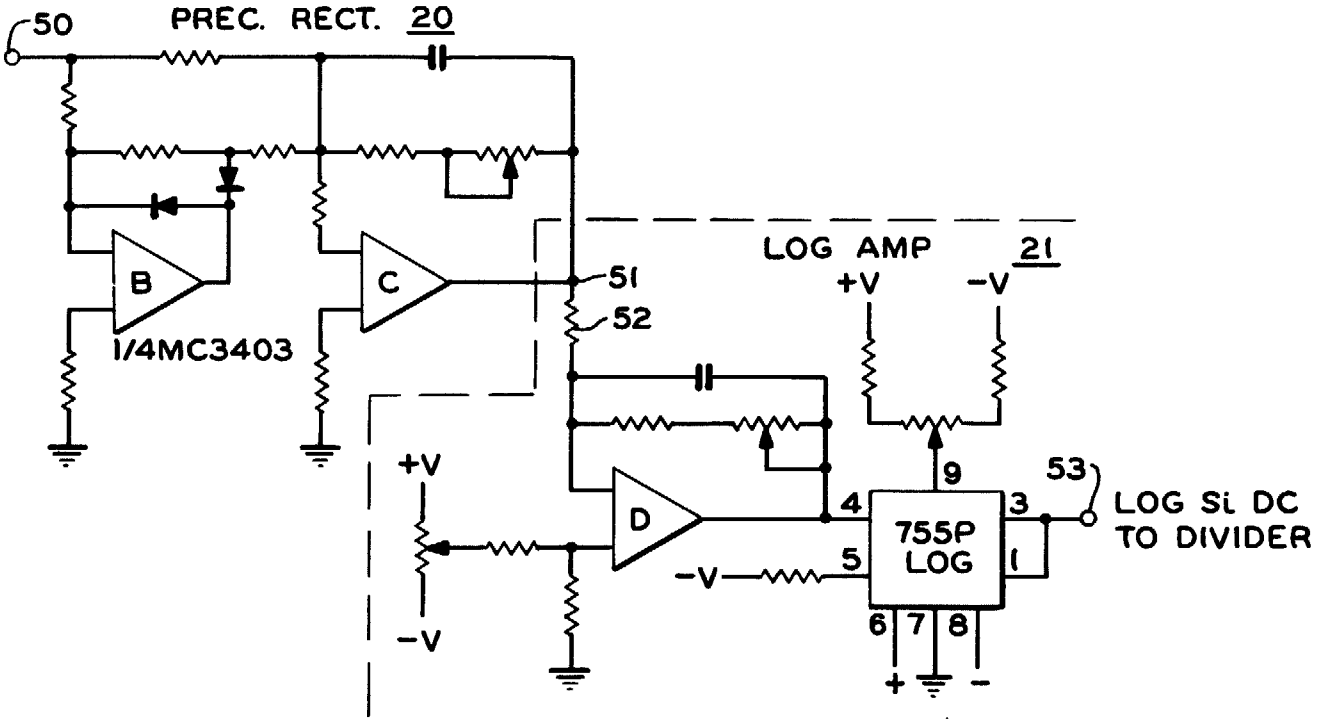
Figure 10:
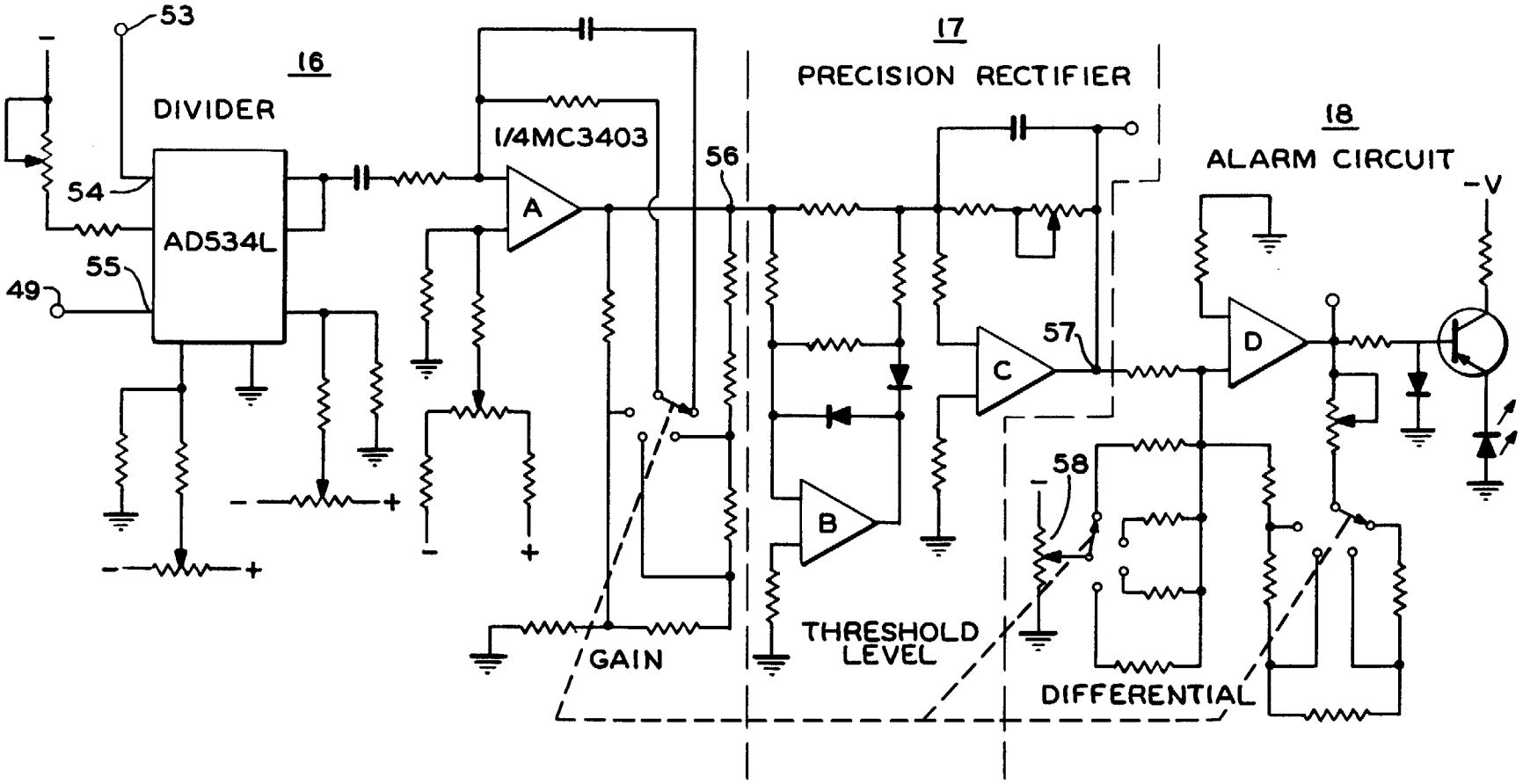

Turning now to FIGS. 8, 9 and 10 there is shown a schematic presentation of the apparatus of FIG. 1. In FIG. 8 the PbS detector 11, which is an IR responsive photoconductive sensor, and the Si detector 10, which is a visible spectrum responsive photovoltaic device are connected to the inputs of preamps 12 and 13, respectively. Amplifier 12 output is connected by a summing resistor 40 to the input of adder 14. Similarly amplifier 13 output is connected by a summing resistor 41 to the adder input. Thus the AC (flicker) components of the signals sensed by the two sensors are combined at adder 14. DC components of the signal are blocked by capacitor 42.

Figure 11:
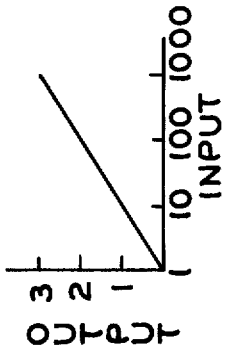
FIG. 11 is a graph of operating characteristics of the logarithmic amplifier of FIG. 1.

Since it is desired to consider the flicker components in the frequency range of 75–400 Hz, the band-pass filter 15 is provided. As shown herein it comprises a high pass section 43 feeding into a low pass section 44 which feeds into another high pass section 45 to form the desired band-pass function and provide an output at terminal 49. A quad. op. amp. such as a TL084 has been used as the amplifier sections 46, 47 and 48 of the band-pass filter. Referring now to FIG. 9 there is shown the schematic of the precision rectifier 20 and the log. amp. 21 which were earlier referred to in the block diagram. The overall signal from the Si flame detector 10 as amplified by preamp 13 is connected by terminal 50 to the input of the precision rectifier 20. This rectifier is a conventional circuit and the amplifiers shown at B and C thereof may be elements of a quad. op. amplifier MC3403, for example. The DC output of the rectifier at terminal 51 is fed into the log. amplifier 21 circuit at resistor 52. The log. amp. which has an input-output characteristic generally as shown in FIG. 11, may be an Analog Devices type 755P, for example. The output 53 of the log. amp. 21 is connected to the divisor input 54 of the divider 16 (FIG. 10). The dividend input 55 of the divider receives its signal from the output 49 of the band-pass filter 15. The effect of the divider 16 is that the AC signal from the sensors 10 and 11, as amplified and operated on by the band-pass filter, is divided by a signal at terminal 49 which is a function of the log. of the signal from the Si sensor 10. The divider 16 may be an Analog Devices type AD534L (multiplier-divider). Another explanation of the function of the divider in the circuit is that it acts somewhat like an automatic gain control circuit. The output of the divider at 56 is converted to DC at precision rectifier circuit 17. The DC output of the rectifier at 57 is applied to the alarm circuit 18, which is a switching circuit having a threshold level which can be adjusted at potentiometer 58.

The embodiments of the invention in which an exclusive property or right is claimed are defined as follows:

1. In a multi-burner boiler installation of the type described, a flame monitoring system for a burner comprising:

first flame radiation sensing means responsive to a first radiation wavelength range, said first means providing a first electrical signal indicative of flame radiation sensed at said first wavelength range;

dissimilar flame radiation sensing means responsive to a different radiation wavelength range than said first means, said dissimilar means providing a second electrical signal indicative of flame radiation sensed at said different wavelength range;

a burner of said multi-burner installation for providing a proximate burner flame;

means positioning said first and said dissimilar sensing means to receive radiation from the proximate flame;

means for summing said first and second electrical signals from said sensing means;

filter means for passing the AC flicker components and filtering out the DC components of the summed signals to provide an AC output signal;

means for rectifying to DC said first electrical signal to provide a third signal;

non-linear amplifying means for compressing the dynamic range of said third signal which may vary in intensity by orders of magnitude at the input, to provide an output signal which is a function of the input signal but compressed in dynamic range;

divider means having a dividend input and a divisor input;

means connecting the compressed signal to the divisor input;

means connecting the AC output signal to the dividend input; and, further means connecting the output of the divider means to indicator means.

2. In a multi-burner boiler installation of the type disclosed, a flame monitoring system for a burner comprising:

first flame radiation responsive sensing means responsive to a first radiation wavelength range, said first means providing a first electrical signal indicative of flame radiation sensed at said first wavelength range;

dissimilar flame radiation responsive sensing means responsive to a different radiation wavelength range than said first means, said dissimilar means providing a second electrical signal indicative of flame radiation sensed at said different wavelength range;

said two sensing means being adapted to be positioned to receive radiation from the flame of a burner of a multi-burner installation;

means for summing said first and second electrical signals from said sensing means;

filter means for passing the AC flicker components and filtering out the DC components of the summed signals to provide an AC output signal;

means for rectifying to DC said first electrical signal to provide a third signal;

non-linear amplifying means for compressing the dynamic range of said third signal which may vary in intensity by orders of magnitude at the input, to provide an output signal which is a function of the input signal but compressed in dynamic range;

divider means having a dividend input and a divisor input;

means connecting the compressed signal to the divisor input;

means connecting the AC output signal to the dividend input; and, further means connecting the output of the divider means to indicator means.

3. A flame sensing apparatus comprising:

two dissimilar flame sensors for sensing the radiation from a flame the sensors being responsive at different wavelength ranges, respectively, one from the other, each of said dissimilar sensors providing an electrical output signal in response to sensing the respective flame wavelength radiations, each of said signals having a DC component and an AC component;

adder means summing together the electrical output signals from said two sensors;

band-pass filter means connected to said adder means to select for use the AC component of said signals;

divider means receiving the AC component of said signals at its dividend input, said means also having a divisor input and an output;

circuit means connected to receive a signal output of a first of said radiation detectors and providing a dynamically compressed signal which is a non-linear function of the signal magnitude received to the divisor input of said divider means whereby the signal at the dividend input is divided by the signal at the divisor input; and, means including indicator means connected to receive the signal output of said divider means.

4. Apparatus according to claim 3 wherein the circuit means comprises a logarithmic amplifier.

5. A flame monitoring system for use in a pulverized coal burning multi-burner furnace/boiler installation comprising:

two dissimilar flame radiation responsive sensing means each responsive to different radiation wavelength ranges, respectively, including first flame sensing means responsive to flame visible light radiation, said first means providing a first electrical signal indicative of visible radiation sensed, and second flame sensing means responsive to flame infrared radiation, said means providing a second electrical signal indicative of infrared radiation sensed, said first and second means being adapted for mounting on a furnace installation and positioned to receive visible and infrared radiation from a burner flame each of said first and second electrical signals having a DC component and an AC flicker component;

means connecting said first and second signals to an adder circuit to sum the outputs of the sensing means;

bandpass means for passing the AC flicker components and filtering out the DC components of the added signals to provide an AC output signal;

rectifying means for rectifying to DC said first electrical signal to provide a third signal;

non-linear amplifying means for compressing the dynamic range of said third signal which may vary in intensity by orders of magnitude at the input, to provide an output signal which is a function of the first signal but compressed in dynamic range;

divider means having a dividend input and a divisor input;

means connecting the compressed signal to the divisor input;

means connecting the AC output signal to the dividend input; and, further means connecting the output of the divider means to indicator means.

6. The apparatus according to claim 1, 2 or 3 wherein said first radiation wavelength range is from about 0.35 um to about 1.1 um and said different radiation wavelength range is from about 1.1 um to about 3 um.

7. The apparatus according to claim 1, 2, 3 or 5 wherein said first flame sensing means is a silicon sensor.

8. The apparatus according to claim 1, 2, 3 or 5 wherein said dissimilar flame sensing means is a PbS sensor.

9. The apparatus according to claim 1, 2 or 5 wherein said non-linear amplifying means comprises a logarithmic amplifier.

10. The apparatus according to claim 1, 2 or 5 wherein said further means comprises rectifying means following said divider means.

11. Apparatus according to claims 1 or 2 wherein said first radiation wavelength range includes at least part of the visible light wavelength range.

12. Apparatus according to claims 1 or 2 wherein said filter means is a bandpass filter means.

* * * * *